United States Patent [19]

Castelli et al.

[11] 4,215,932

[45] Aug. 5, 1980

[54] REPLENISHABLE PHOTOCONDUCTIVE SYSTEM

[75] Inventors: Vittorio Castelli, Scarsdale; Ralph A. Hamaker, Penfield, both of N.Y.; Stephen T. Chai, Rancho Palos Verdes, Calif.

[73] Assignee: Xerox Corporation, Stamford, Conn.

[21] Appl. No.: 53,645

[22] Filed: Jun. 29, 1979

[51] Int. Cl.[3] ..... G03G 15/00

[52] U.S. Cl. ..... 355/16; 156/159; 156/502; 242/58.1; 355/3 BE

[58] Field of Search ..... 355/16, 3 BE, 3 R; 242/58.1, 58.2, 58.3, 58.4, 58.5; 156/157, 159, 502, 505

[56] References Cited

U.S. PATENT DOCUMENTS

| | | | |
|---|---|---|---|
| 3,600,082 | 8/1971 | Knechtel | 355/16 X |
| 3,619,050 | 11/1971 | Swanke | 242/58.1 X |
| 3,877,806 | 4/1975 | Schrempp et al. | 355/16 X |
| 3,984,241 | 10/1976 | Schrempp | 355/16 X |
| 4,065,067 | 12/1977 | Martinez | 242/58.1 |
| 4,088,403 | 5/1978 | Kingsley | 355/16 |
| 4,111,741 | 9/1978 | Paul | 242/58.1 |

*Primary Examiner*—R. L. Moses

*Attorney, Agent, or Firm*—H. M. Brownrout; C. A. Green; H. Fleischer

[57] ABSTRACT

An apparatus and method of use in which a first photoconductive belt arranged to move about an endless operative path in an electrophotographic printing machine is replaced by a second photoconductive belt. The leading marginal region of the second photoconductive belt is secured to the first photoconductive belt. As the first photoconductive belt moves about the operative path, it positions the second photoconductive belt thereabout. After the second photoconductive belt is positioned about the operative path, the first photoconductive belt is removed therefrom and separated from the second photoconductive belt. The leading marginal region of the second photoconductive belt is then secured to the trailing marginal region thereof.

15 Claims, 3 Drawing Figures

REPLENISHABLE PHOTOCONDUCTIVE SYSTEM

This invention relates generally to an electrophotographic printing machine, and more particularly concerns an improved apparatus for replacing used photoconductive belts in the printing machine.

In an electrophotographic printing machine, a photoconductive belt is charged to a substantially uniform potential so as to sensitize the surface thereof. The charged portion of the photoconductive belt is exposed to a light image of an original document being reproduced. Exposure of the charged photoconductive belt selectively dissipates the charge thereon in the irradiated area. This records an electrostatic latent image on the photoconductive belt corresponding to the informational areas contained within an original document being reproduced. After the electrostatic latent image is recorded on the photoconductive belt, the latent image is developed by bring a developer mix into contact therewith. Generally, the developer mix comprises toner particles adhering triboelectrically to carrier granules. The toner particles are attracted from the carrier granules to the latent image forming a toner powder image on the photoconductive belt. Next, the toner powder image is transferred from the photoconductive belt to a copy sheet. The copy sheet is then heated to permanently affix the toner powder image thereto. This general approach was disclosed by Carlson in U.S. Pat. No. 2,297,691, and has been further amplified and described by many related patents in the art.

Generally, when a photoconductive belt is employed in an electrophotographic printing machine, a section of the path is flat permitting a planar image of the original document to be flash exposed thereon. When the light intensity of the flash is sufficiently high, the exposure time may be of a sufficiently short duration to prevent blurring of the electrostatic latent image recorded on the continuously moving photoconductive belt. The short flash exposure of the original document facilitates high speeds in electrophotographic printing.

Various types of materials have been devised for photoconductive belts. One well known material is made from a selenium alloy which is capable of producing a large number of copies before replacement is required. Another material may be of an organic type. However, the organic materials frequently have a shorter useful life and require more frequent replacement.

Various types of devices have hereinbefore been developed to replace the photoconductive belt utilized in an electrophotographic printing machine. The following art appears to be relevant:

U.S. Pat. No. 3,600.082
Issued: Aug, 17, 1971
Patentee: Knechtlel
U.S. Pat. No. 3,619,050
Issued: Nov. 9, 1971
Patentee: Swanke
U.S. Pat. No. 3,877,806
Issued: Apr. 15, 1975
Patentee: Schrempp et al.
U.S. Pat. No. 3,984,241
Issued: oct. 5, 1976
Patentee: Schrempp et al.

The pertinent portions of the foregoing art may be briefly summarized as follows:

Knechtlel describes a photoconductive web which advances from a supply reel to a take-up reel. When it is desirable to install a new web, the unit is rocked to expose the path of travel of the web over the rollers. A new web is placed over the rollers with its leading end secured on the take-up reel. The unit is then returned to the operative position. Alternatively, the unit may be fed horizontally to expose the web path of travel.

Swanke discloses a device for replacing a used electrophotosensitive web with a new one. The used web is attached to a tow bar. The tow bar separates the leading and trailing ends of the used web. The used web is then fed back into a cartridge for disposal. After the cartridge containing the used web has been removed from the printing machine, a new cartridge is inserted therein. The tow bar picks up the leading end of the new web and threads it through the machine. The trailing end of the web is then secured to the tow bar form a continuous web.

The Schrempp et al. patents describe a photoconductive belt having a replacement segment located in a cartridge which moves with the belt around the operative path. The belt and cartridge form a unified assembly which is replaced in its entirety when the photoconductive belt is used. One end of the belt is connected to a supply reel with the other end being connected to a take-up reel. Both the supply reel and the take-up reel are located in the cartridge. As the photoconductive belt is driven around the operative path, incremental portions thereof are advanced from the supply spool and taken up on the take-up spool.

In accordance with the features of the present invention, there is provided an apparatus for replacing a first photoconductive belt arranged to move about an endless operative path in an electrophotographic printing machine with a second photoconductive belt. The apparatus includes means for substantially permanently securing the leading marginal region of the second photoconductive belt to a portion of the first photoconductive belt. This enables the first photoconductive belt to move the second photoconductive belt about the operative path as it moves thereabout. Means are provided for removing the first photoconductive belt from the operative path after positioning the second photoconductive belt thereabout. The leading material region of the second photoconductive belt is then separated from the first photoconductive belt. Thereafter, means attach substantially permanently the leading marginal region of the second photoconductive belt to the trailing marginal region thereof.

Other aspects of the invention will become apparent as the following description proceeds and upon reference to the drawings, in which.

While the present invention will hereinafter be described in connection with various preferred embodiments and methods of use thereof, it will be understood that it is not intended to limit the invention to these embodiments. On the contrary, it is intended to cover all alternatives, modifications, and equivalents as may be included within the spirit and scope of the invention as defined by the appended claims.

Figure 1:
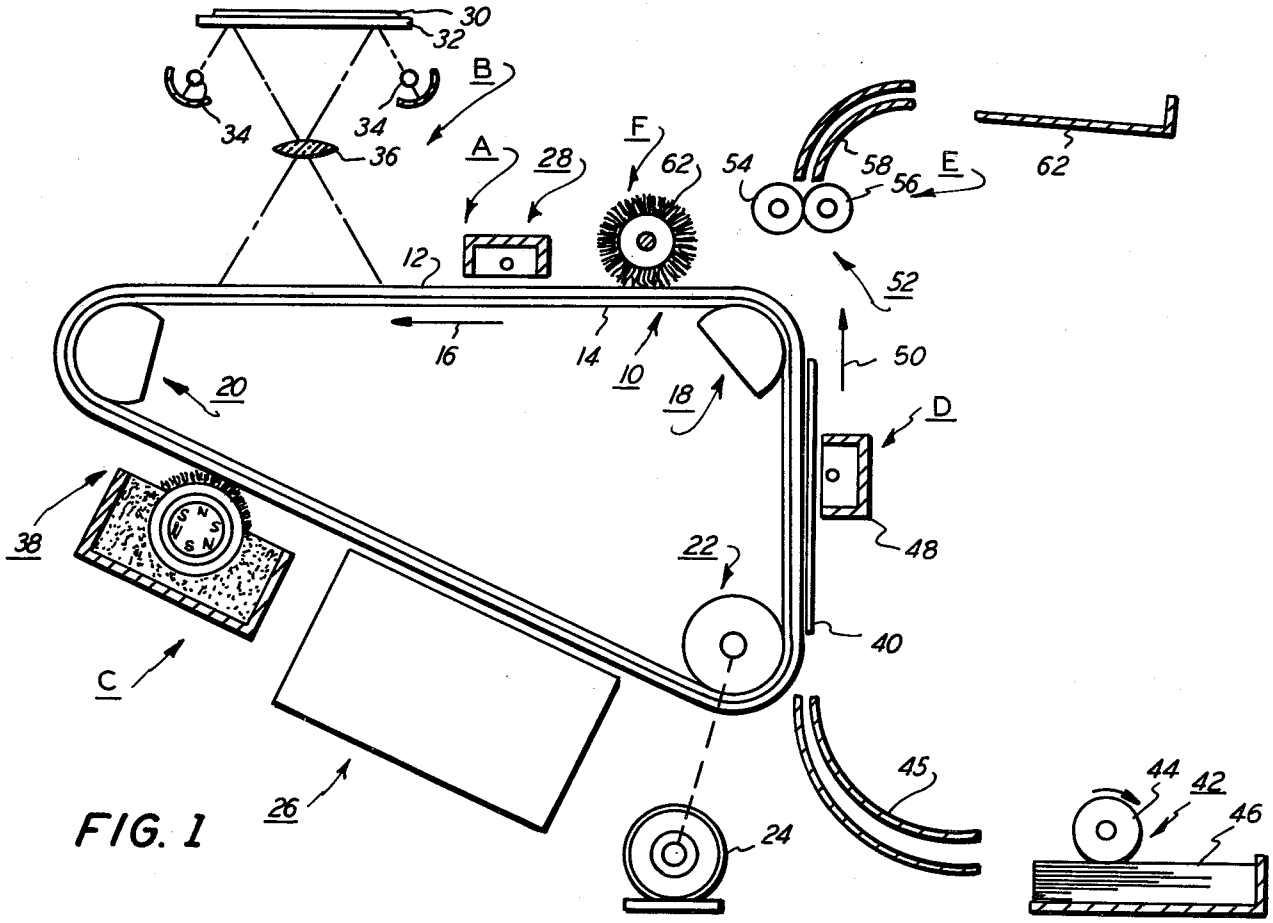
FIG. 1 is a schematic elevational view depicting an electrophotograph printing machine incorporating the features of the present invention therein.

For a general understanding of the illustrative electrophotographic printing machine incorporating the features of the present invention, reference is had to the drawings. In the drawings, like reference numerals have been used throughout to designate identical elements. FIG. 1 schematically depicts the various components of the electrophotographic printing machine employing the photoconductive belt replenishment mechanism of the present invention therein. Although the belt replenishment mechanism is particularly well adapted for use in an electrophotographic printing machine, it will become evident from the following discussion that it is equally well suited for use in a wide variety of devices and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

Turning now to FIG. 1, the electrophotographic printing machine employs a belt 10 having a organic photoconductive surface 12 secured releasably to a conductive substrate. Belt 10 moves in the direction of arrow 16 to advance successive portions of photoconductive surface 12 through the various processing stations disposed about the path of movement thereof. As shown, belt 10 is entrained about stripping roller 18, tension roller 20, and drive roller 22. Tension roller 20 is mounted resiliently on a pair of springs (not shown) so as to maintain belt 10 under tension. End guides or flanges are positioned on both sides of tension roller 20 to define a passageway through which belt 10 passes. Drive roller 22 is in engagement with belt 10 and advances belt 10 in the direction of arrow 16. Roller 22 is rotated by motor 24 coupled thereto by suitable means, such as a belt drive (not shown).

Belt 10 is designed to be periodically removed from the printing machine and replaced with a new photoconductive belt. This prevents copy quality degradation in the printing machine. The printing machine employs logic circuitry which includes a counter. The counter registers the number of copies reproduced. After a predetermined number of copies have been reproduced, e.g. 40,000, the replenishment mechanism, indicated generally by the reference numeral 26, is actuated. Initially, a new photoconductive belt is advanced from replenishment mechanism 26 and secured to the old photoconductive belt entrained about rollers 18, 20, and 22. The old photoconductive belt is then severed. Drive roller 22 is then actuated to advance the old photoconductive belt and the new photoconductive belts in the direction of arrow 16. This threads the new photoconductive belt about rollers 18, 20, and 22. After the new photoconductive belt has been threaded about rollers 18, 20 and 22, the old photoconductive belt is severed therefrom. At that time, the leading and trailing edges of the new photoconductive belt are secured to one another. This forms a continuous photoconductive belt which acts as a replacement for photoconductive belt removed from rollers 18, 20, and 22. Generally, at the initiation of the replenishment cycle, tension roller 20 is retracted slightly to reduce the tension in belt 10. This more readily permits the removal of the old photoconductive belt and the replacement therewith with a new photoconductive belt. After the new photoconductive belt has been threaded about rollers 18, 20 and 22, the leading and trailing edges thereof are secured to one another, tension roller 20 is returned to its operative position placing the new photoconductive belt under the desired tension. The new photoconductive belt is now in the operative position permitting the printing machine to be actuated to reproduce a new series of copies. The detailed structure of the various embodiments of replenishment mechanism 26 will be described hereinafter with reference to FIGS. 2 and 3.

With continued reference to FIG. 1, the operation of the electrophotographic printing machine will now be briefly described. Initially, a portion of photoconductive surface 12 passes through charging station A. At charging station A, a corona generating device, indicated generally by the reference numeral 28, charges photoconductive surface 12 to a relatively high, substantially uniform potential.

Next, the charged portion of photoconductive surface 12 is advanced through exposure station B. At exposure station B, an original document 30 is positioned face-down upon transparent platen 32. Lamps 34 flash light rays onto the original document. The light rays reflected from the original document are transmitted through lens 38 and focused onto the charged portion of photoconductive surface 12. The charged portion of photoconductive surface 12 is selectively discharged by the light image of the original document. This records an electrostatic latent image on photoconductive surface 12 which corresponds to the informational areas contained within original document 32.

Thereafter, belt 10 advances the electrostatic latent image recorded thereon to development station C. At development station C, a magnetic brush developer roller 38 moves the developer mix into contact with the electrostatic latent image recorded on belt 10. The developer mix comprises carrier granules having toner particles adhering triboelectrically thereto. The magnetic brush developer roller forms a chain-like array of developer mix extending in an outwardly direction therefrom. The developer mix contacts the electrostatic latent image recorded on belt 10. The latent image attracts the toner particles from the carrier granules forming a toner powder image on photoconductive surface 12.

The toner powder image deposited on photoconductive surface 12 is then advanced to transfer station D. At transfer station D, a sheet of support material 40 is positioned in contact with the toner powder image formed on photoconductive surface 12. transfer station D by a sheet feeding apparatus, indicated generally by the reference numeral 42. Preferably, sheet feeding apparatus 42 includes a feed roll 44 contacting the uppermost sheet of the stack 46 of sheets of support material. Chute 45 directs the advancing sheet of support material into contact with photoconductive surface 12 in a timed sequence so that the toner powder image developed thereon contacts the advancing sheet of support material at transfer station D.

Transfer station D includes a corona generating device 48 which applies a spray of ions to the backside of sheet 40. This attracts the toner powder image from photoconductive surface 12 to sheet 40. After transfer, sheet 40 continues to move in the direction of arrow 50 and is separated from photoconductive surface 12 by a detack corona generating device (not shown) which neutralizes the charge causing sheet 40 to adhere to photoconductive surface 12. A conveyor system (not shown) advances sheet 40 from belt 10 to fusing station E.

Fusing station E includes a fuser assembly, indicated generally by the reference numeral 52, which permanently fixes the transferred toner powder image to sheet 40. Preferably, fuser assembly 52 includes a heated fuser roller 54 and a back-up roller 56. Sheet 40 passes between fuser roller 54 and back-up roller 56 with the toner powder image contacting fuser roller 54. In this manner, the toner powder image is permanently fixed to sheet 40. After fusing, chute 58 guides the advancing sheet 40 to catch tray 60 for subsequent removal from the printing machine by the operator.

Invariably, after the sheet of support material is separated from photoconductive surface 12, some residual particles remain adhering thereto. These residual particles are removed from photoconductive surface 12 at cleaning station F. Preferably, cleaning station F includes a rotatably mounted fiberous brush 62 in contact with photoconductive surface 12. The particles are cleaned from photoconductive surface 12 by the rotation of brush 62 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating therein the photoconductive belt replenishment mechanism of the present invention.

Figure 2:
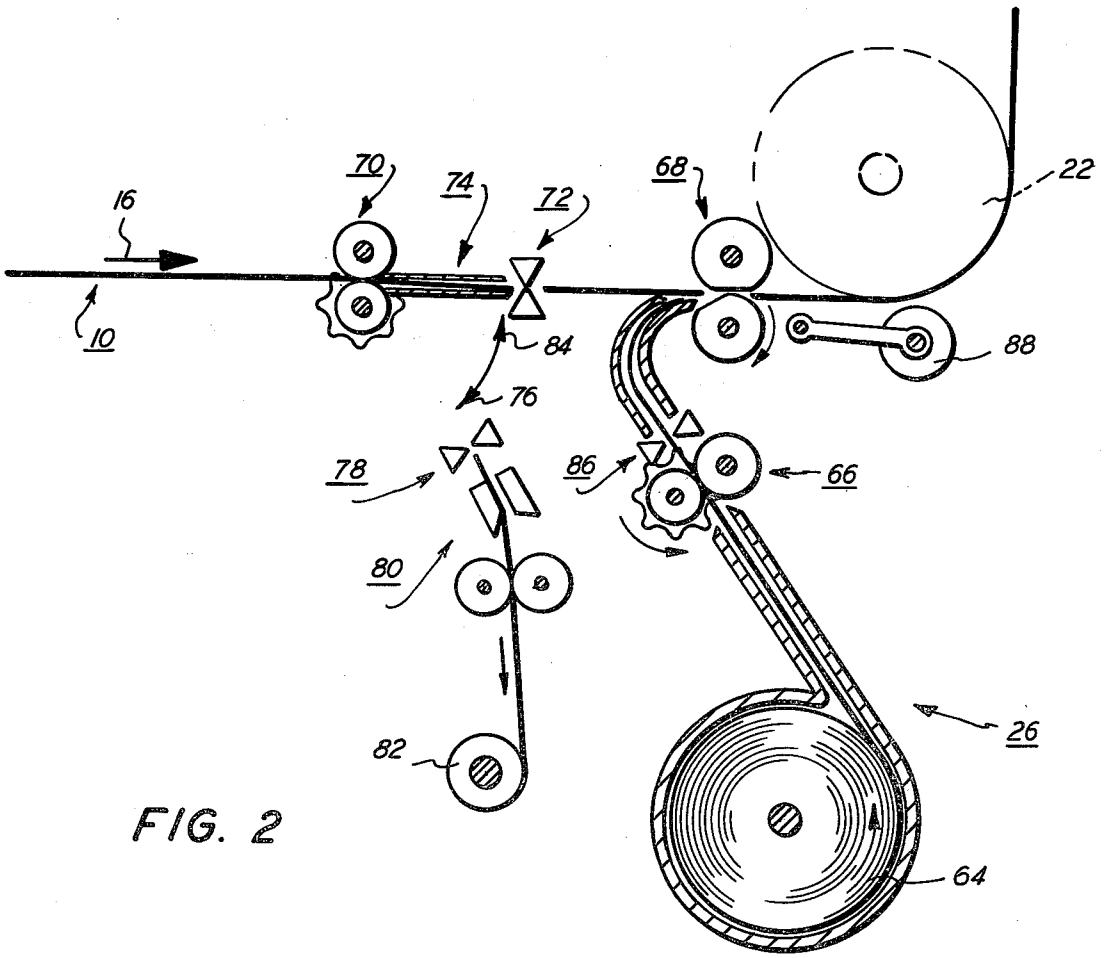
FIG. 2 is a fragmentary elevational view showing one embodiment of an apparatus used in replace the photoconductive belt employed in the FIG. 1 printing machine.

Referring now to the specific subject matter of the invention, FIG. 2 depicts one embodiment of replenishment mechanism 26 in greater detail. As shown thereat, initially belt 10 is stopped, i.e. by de-energizing motor 24 (FIG. 1). Thereafter, tension roller 20 is retracted to reduce the tension in belt 10 and replenishment mechanism 26 actuated. Replenishment mechanism 26 includes a supply spool 64 having a continuous web of photoconductive material wound thereabout. After belt 10 is stopped and the tension therein reduced, sprocket rollers 66 are energized to advance the leading marginal region of the photoconductive material (hereinafter referred to as the new photoconductive belt) wound about supply spool 64 into contact with the old photoconductive belt 10. The leading marginal edge region of the new photoconductive belt has a strip of double sided pressure sensitive adhesive secured thereto. By way of example adhesive tape number 665 manufactured by the Minnesota Mining and Manufacturing Company performed reasonably satisfactorily. Rollers 68 are initially spaced apart to receive the leading marginal region of the new photoconductive belt contacting the old belt. Once the leading marginal region of the new belt and old belt are interposed therebetween, rollers 68 are moved toward one another to apply pressure thereon so as to cement the leading marginal region of the new photoconductive belt to the old photoconductive belt. In this manner, the new photoconductive belt is secured to the old photoconductive belt. Sprocket drive rollers 66 are then disengaged. and sprocket drive rollers 70 engaged, However, drive rollers 76 are not energized and belt 10 remains substantially stationary. After sprocket drive roller 70 are engaged, cutter or knife 72 is energized.. Knife 72 cuts the old photoconductive belt forming a leading and trailing marginal region. Gate 74 is then pivoted in a downwardly direction, as indicated by arrow 76, so as to be aligned with cutter or knife 78 and fastner rollers 80. At this time, fastener rollers 68 are spaced from one another with sprocket drive rollers 70 being energized to advance the leading marginal region of the old photoconductive belt until it overlaps the trailing marginal region of the leader extending from take-up spool 82. The trailing marginal region of the leader extending from take-up spool 82 has an adhesive strip thereon. The adhesive strip is positioned in contact with the leading marginal region of the old photoconductive belt between fastener rollers 80. Fastener rollers 80 are energized to bring the rollers into contact with the overlapped leading marginal portion of the old photoconductive belt and the trailing marginal region of the leader extending from take-up spool 82. The pressure applied thereto cements the leading marginal region of the old photoconductive belt to the trailing marginal region of the belt leader extending from take-up spool 82. After securing the leading marginal region of the old photoconductive belt to the trailing marginal region of the take-up spool leader, sprocket drive rollers 70 are de-energized and fastener rollers 80 are spaced from one another. Take-up spool 82 is then energized to wind the old photoconductive belt thereabout. As the old photoconductive belt is wound about take-up spool 82, the new photoconductive belt advances from supply spool 64 and is threaded about drive roller 22, stripping roller 18 and tension roller 20. After the trailing marginal region of the old photoconductive belt having the leading marginal region of the new photoconductive belt secured thereto passes through cutter 78, take-up spool 82 is de-energized. Cutter 78 is then energized severing the leading marginal region of the new photoconductive belt from the old photoconductive belt. Gate 74 is then pivoted in an upwardly direction, as indicated by arrow 84. Sprocket drive rollers 70 are once again energized advancing the leading marginal region of the new photoconductive belt between fastener rollers 68. The leading marginal region of the new photoconductive belt now overlaps a portion of the new photoconductive belt postitioned between fastner rollers 68. Fastener rollers 68 are energized to move toward one another. Since the portion of the new photoconductive belt overlapping with the leading marginal region thereof has an adhesive strip thereon, the pressure from fastening rollers 68 cements the leading marginal region of the new photoconductive belt to the trailing portion of the new belt. Thereafter, cutter 86 is energized severing the trailing portion of the new photoconductive belt from the remaining web of photoconductive material wound about supply spool 64. Sprocket rollers 70 are then disengaged and pinch roller 88 is cammed away from drive roller 22. Roller 20 is then moved to the operative position placing the new photoconductive belt under the desired tension. Thereafter, motor 24 may be energized to rotate drive roller 22 so that the printing machine may reproduce a new series of copies.

By way of example, a photosensor (not shown) is positioned prior to rollers 70 so as to detect the passage of a belt seam. In this way, the belt is permitted to advance a pre-determined distance to enable the new belt to be threaded about the belt support rollers. All of the sprocket drive rollers are engaged and disengaged by suitable clutches. The fastening rollers and gates are moved by suitable solenoids coupled thereto. Each knife or cutter may be a hot wire. The machine logic, coupled to the photosensor detecting the belt seam, actuates the respective clutches and solenoids in a timed sequence to achieve the foregoing cycle of events.

Figure 3:
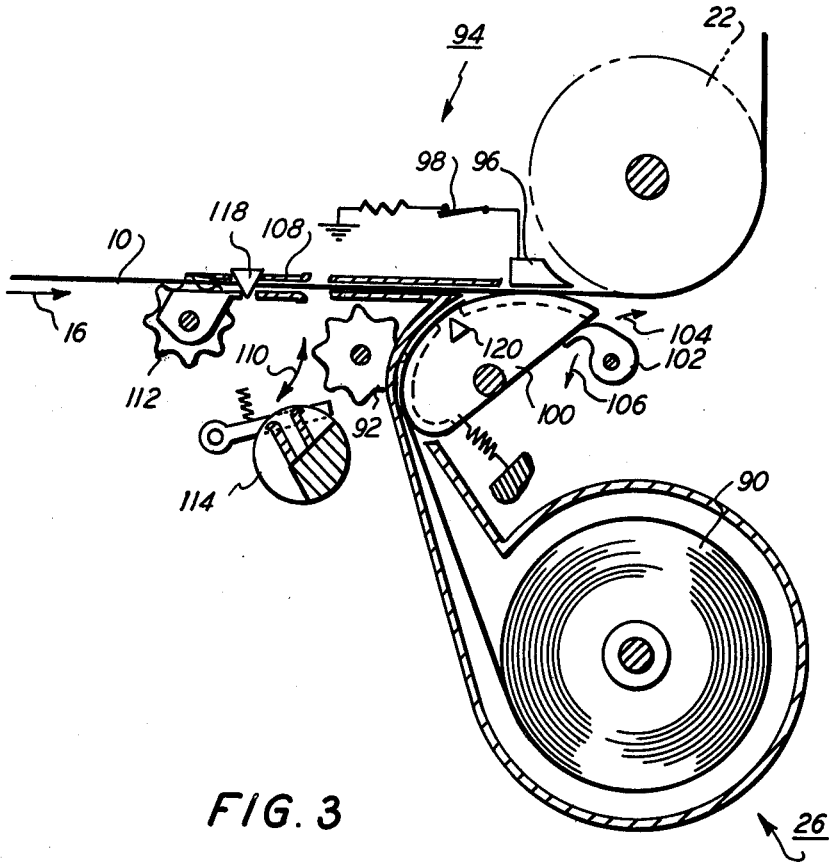
FIG. 3 is a fragmentary elevational view showing another embodiment of an apparatus used to replace the photoconductive belt employed in the FIG. 1 printing machine.

Turning now to FIG. 3, there is shown another embodiment of replenishment mechanism 26. As depicted thereat, a web of photoconductive material (hereinafter referred to as the new photoconductive belt) is wound about supply spool 90. Sprocket drive rollers 92 are energized to advance the leading marginal region of the new photoconductive belt into contact with the old photoconductive belt at fastening station 94. The leading marginal region of the new photoconductive belt has heat actuable cement thereon. A reasonable suitable cement is number AF 4060 manufactured by the Minnesota Mining and Manufacturing Company. Fastening station 94 includes a hot plate 96 actuated by switch 98, and a platen 100 for supporting the lead marginal region of the old photoconductive belt. Cam 102 pivots in the direction of arrow 104 raising the platen into contact with the overlapped portion of the leading marginal region of the new belt and the old photoconductive belt. Switch 98 is then closed coupling hot plate 96 to a voltage source. This produces sufficient heat to thermally melt the cement securing the leading marginal region of the new photoconductive belt to the old photoconductive belt. Thereafter, tension roller 20 (FIG. 1) is retracted reducing the tension in belt 10. Knife or cutter 106 is energized to sever the old photoconductive belt forming leading and trailing marginal regions thereof. Switch 98 is then opened and cam 102 pivoted in a downwardly direction, as indicated by arrow 106, so as to move platen 100 away from photoconductive belt 10. Gate 108 is then pivoted in a downwardly direction, as indicated by arrow 110. Sprocket drive rollers 90 and 112 are energized to advance the old photoconductive belt in the direction of arrow 16 so as to thread the new photoconductive belt about rollers 18, 20, and 22. The leading marginal region of the old photoconductive belt moves into a guillotine cutter 114 which shreds the old photoconductive belt. Cutter 118 is mounted on gate 108 and pivots downwardly therewith. After the trailing marginal region of the old photoconductive belt has advanced into cutter 114, cutter 118 is energized. This severs the leading marginal region of the new photoconductive belt from the trailing marginal region of the old photoconductive belt. Gate 108 is then pivoted in the direction of arrow 120 and the leading marginal region of the new photoconductive belt is advanced into fastening station 94 overlapping a trailing portion of the photoconductive belt having cement thereon. Once again, cam 102 is pivoted in the direction of arrow 104 raising platen 100 against the overlapped portions of the new photoconductive belt. Switch 98 is then closed heating hot plate 96 causing the overlapped portions of the new photoconductive belt to be secured to one another. Thereafter, cutter or knife 120 is energized severing the photoconductive belt entrained about rollers 18, 20 and 22 from the remaining web of photoconductive material wound about supply spool 90. Sprocket drive rollers 90 and 112 are then de-energized and tension roller 20 is returned to the operative position placing the new photoconductive belt under the desired tension. Motor 24 may then be energized to drive drive roller 22 causing the new photoconductive belt to move about the operative path. The electrophotographic printing machine is now capable of reproducing a new series of copies.

By way of example, a photosensor (not shown) is located before rollers 112 so as to detect the passage of a belt seam. This enables the belt to advance a distance sufficient to be entrained about the support rollers. As previously indicated with regard to the embodiment depicted in FIG. 3, all of the sprocket drive rollers may be engaged and disengaged by suitable clutches. The gates are moved by suitable solenoids coupled thereto. Each knife or cutter may be a hot wire. The machine logic, coupled to the photosensor detecting the belt seam, energizes the respective clutches and solenoids in a timed sequence to achieve the foregoing cycle of events.

In recapitulation, the electrophotographic printing machine of the present invention includes a replenishment mechanism which secures a new photoconductive belt to the old photoconductive belt. The old photoconductive belt is then cut defining leading and trailing marginal regions thereof. The new photoconductive belt, which is secured to the trailing marginal region of the old photoconductive belt, is threaded about the belt supports. After the trailing marginal region of the old photoconductive belt leaves the belt supports, it is cut from the new photoconductive belt. The leading marginal region of the new photoconductive belt is then secured to the trailing portion thereof. Thereupon, the new photoconductive belt is severed from the web of photoconductive material remaining wound on the supply spool. In this manner, an old photoconductive belt is replaced with a new photoconductive belt.

It is, therefore, evident that there has been provided in accordance with the present invention, an apparatus for replenishing a photoconductive belt in an electrophotographic printing machine that fully satisfies the aims and advantages hereinbefore set forth. While this invention has been described in conjunction with specific embodiments and methods of use thereof, it will be evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for replacing a first photoconductive belt arranged to move about an endless operative path in an electrophotographic printing machine with a second photoconductive belt, including:

means for substantially permanently securing the leading marginal region of the second photoconductive belt to a portion of the first photoconductive belt so as to position the second photoconductive belt about the operative path as the first conductive belt moves thereabout;

means for removing the first photoconductive belt from the operative path after positioning the second photoconductive belt thereabout and separating the second photoconductive belt from the first photoconductive belt; and means for substantially permanently attaching the leading marginal region of the second photoconductive belt to the trailing marginal region thereof.

2. An apparatus as recited in claim 1, further including:

means for storing the second photoconductive belt; and means for feeding the second photoconductive belt from said storing means to position the leading marginal region thereof in contact with a portion of the first photoconductive belt.

3. An apparatus as recited in claim 2, wherein said removing and separating means includes:

means for cutting the first photoconductive belt to form a leading marginal region and a trailing marginal region with the leading marginal region of the second photoconductive belt being secured to the trailing marginal region of the first photoconductive belt;

means for receiving the first photoconductive belt after removal thereof from the operative path; and means for severing the leading marginal region of the second photoconductive belt from the trailing marginal region of the first photoconductive belt.

4. An apparatus as recited in claim 3, wherein said attaching means includes:

means for detaching the portion of the second photoconductive belt remaining in said storing means from the portion of the second photoconductive belt disposed about the operative path to define the trailing marginal region thereof; and means for fixing the leading marginal region of the second photoconductive belt to the trailing marginal region thereof.

5. An apparatus as recited in claims 2, 3, or 4, wherein said storing means includes a supply spool having a continuous photoconductive belt wound thereabout.

6. An apparatus as recited in claim 3 or 4, wherein said receiving means includes a take-up spool arranged to have the first photoconductive belt wound thereabout.

7. An apparatus as recited in claims 2, 3 or 4, wherein said securing means includes means for cementing the leading marginal region of the second photoconductive belt to a portion of the first photoconductive belt.

8. An apparatus as recited in claim 4, wherein said fixing means includes means for cementing the leading marginal region of the second photoconductive belt to the trailing marginal region thereof.

9. A method of replacing a first photoconductive belt arranged to move about an endless operative path in an electrophotographic printing machine with a second photoconductive belt, including the steps of: p1 securing substantially permanently the leading marginal region of the second photoconductive belt to a portion of the first photoconductive belt so as to position the second photoconductive belt about the operative path as the first photoconductive belt moves therealong;

removing the first photoconductive belt from the operative path during the positioning of the second photoconductive belt along;

separating the second photoconductive belt from the first photoconductive belt; and attaching substantially permanently the leading marginal region of the second photoconductive belt to the trailing marginal region thereof.

10. A printing machine as recited in claim 9, further including the steps of:

storing the second photoconductive belt on a suply spool; and feeding the second photoconductive belt from the supply spool to position the leading marginal region thereof in contact with a portion of the first photoconductive belt.

11. A method as recited in claim 10, wherein said step of removing includes:

cutting the first photoconductive belt to form a leading marginal region and a trailing marginal region with the leading marginal region of the second photoconductive belt being secured to the trailing marginal region of the first photoconductive belt; and winding the first photoconductive belt onto a take-up spool.

12. A method as recited in claim 11, wherein said step of separating includes the step of severing the leading marginal region of the second photoconductive belt from the trailing marginal region of the first photoconductive belt.

13. A method as recited in claim 12, wherein said step of attaching includes the steps of:

detaching the portion of the second photoconductive belt remaining on the supply spool from the portion of the second photoconductive belt disposed about the operative path to define the trailing marginal region thereof; and fixing the leading marginal region of the second photoconductive belt to the trailing marginal region thereof.

14. A method as recited in claim 13, wherein said step of fixing includes the step of cementing the leading marginal region of the second photoconductive belt to the trailing marginal region thereof.

15. A method as recited in claim 9, wherein said step of securing includes the step of cementing the leading marginal region of the second photoconductive belt to a portion of the first photoconductive belt.

* * * * *